US011116325B2

(12) United States Patent
Alletto, Jr.

(10) Patent No.: US 11,116,325 B2
(45) Date of Patent: Sep. 14, 2021

(54) ZERO GRAVITY BED

(71) Applicant: BEDGEAR, LLC, Farmingdale, NY (US)

(72) Inventor: Eugene Alletto, Jr., Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 361 days.

(21) Appl. No.: 15/925,946

(22) Filed: Mar. 20, 2018

(65) Prior Publication Data

US 2018/0271298 A1 Sep. 27, 2018

Related U.S. Application Data

(60) Provisional application No. 62/476,082, filed on Mar. 24, 2017.

(51) Int. Cl.
*A47C 20/08* (2006.01)
*A61G 7/015* (2006.01)
(Continued)

(52) U.S. Cl.
CPC ..... *A47C 20/08* (2013.01); *A47C 20/048* (2013.01); *A61G 7/015* (2013.01); *A47C 19/04* (2013.01);
(Continued)

(58) Field of Classification Search
CPC ..... A47C 20/08; A47C 20/048; A47C 19/04; A47C 19/045; A61G 7/015; A61G 7/018; B66F 7/065
(Continued)

(56) References Cited

U.S. PATENT DOCUMENTS 618,407 A * 1/1899 Forbes ..... A61G 7/015 5/617
1,345,760 A * 7/1920 Frye ..... A61G 7/015 5/611
(Continued)

FOREIGN PATENT DOCUMENTS

CN 205083935 U 3/2016
CN 205548102 9/2016
(Continued)

OTHER PUBLICATIONS

International Preliminary Report on Patentability, International Bureau of WIPO, PCT/US2018/023252, dated Sep. 24, 2019.
(Continued)

*Primary Examiner* — Nicholas F Polito
*Assistant Examiner* — Luke Hall
(74) *Attorney, Agent, or Firm* — Sorell, Lenna & Schmidt, LLP

(57) ABSTRACT

A bed frame is provided that includes a lower frame and an upper frame having a first section, a second section and a third section. The second section is positioned between the first section and the third section. The first section is pivotable relative to the lower frame. The third section is fixed relative to the lower frame. The second section is pivotable relative to the first section and the third section. A lifting assembly includes a first end that is coupled to the lower frame and a second end that is coupled to the second section. The lifting assembly is configured to selectively move the second section toward and away from the lower frame.

20 Claims, 3 Drawing Sheets

(51) Int. Cl.
*A47C 20/04* (2006.01)
*A61G 7/018* (2006.01)
*A47C 19/04* (2006.01)
*B66F 7/06* (2006.01)

(52) U.S. Cl.
CPC ..... *A47C 19/045* (2013.01); *A61G 7/018* (2013.01); *B66F 7/065* (2013.01)

(58) Field of Classification Search
USPC ..... 5/614
See application file for complete search history.

(56) References Cited

U.S. PATENT DOCUMENTS 2,108,913 A * 2/1938 Bawer ..... A61G 7/015 5/617
2,470,161 A * 5/1949 Glasin ..... A61G 7/015 5/618
3,312,985 A * 4/1967 Callaghan ..... A61G 7/015 5/617
RE26,411 E 6/1968 Alsobrook
3,793,652 A * 2/1974 Linehan ..... A61G 7/002 5/607
3,887,950 A * 6/1975 Wachsman ..... A47C 19/045 5/11
3,958,283 A * 5/1976 Adams ..... A61G 7/002 5/616
4,395,786 A * 8/1983 Casey ..... A61G 7/015 5/616
4,403,357 A * 9/1983 Degen ..... A47C 17/04 5/618
4,674,140 A * 6/1987 Boonants ..... A47C 20/04 5/618
4,684,314 A * 8/1987 Luth ..... E21B 19/155 414/746.1
4,792,110 A * 12/1988 Bond ..... B23Q 1/5468 248/651
4,856,129 A 8/1989 Butler
4,885,137 A 12/1989 Lork
4,944,055 A * 7/1990 Shainfeld ..... A47C 17/175 5/618
4,996,731 A * 3/1991 Kruyt ..... A47C 20/041 5/618
5,109,558 A * 5/1992 Di Blasi ..... A61G 7/0573 5/236.1
5,205,004 A 4/1993 Hayes et al.
5,245,718 A * 9/1993 Krauska ..... A61G 7/015 5/618
5,369,825 A * 12/1994 Reesby ..... A61G 13/0009 5/600
5,392,479 A * 2/1995 Liao ..... A61G 7/001 5/607
5,613,255 A * 3/1997 Bish ..... A61G 7/005 5/610
5,996,151 A * 12/1999 Bartow ..... A61G 1/017 5/611
6,006,382 A 12/1999 Smith
6,823,545 B1 11/2004 Davis
6,912,746 B2 * 7/2005 Grove ..... A61G 7/053 297/325
7,146,662 B1 12/2006 Pollard
8,424,134 B2 * 4/2013 Byun ..... A61G 7/0005 5/236.1
9,955,795 B2 * 5/2018 Krenik ..... A47C 23/06
2005/0166323 A1 * 8/2005 Kawakami ..... A61G 7/001 5/610
2007/0245489 A1 * 10/2007 Boudreau ..... A47C 20/046 5/174
2008/0256704 A1 10/2008 Conway
2008/0289112 A1 * 11/2008 Koorey ..... A47C 19/045 5/658
2010/0037397 A1 2/2010 Wood
2010/0205748 A1 * 8/2010 Koorey ..... A47C 19/04 5/658
2011/0245586 A1 10/2011 Slane
2013/0160208 A1 * 6/2013 Davenport ..... A61G 7/008 5/612
2013/0185870 A1 * 7/2013 Ishida ..... A61G 7/02 5/604
2013/0276234 A1 10/2013 Rawls-Meehan
2015/0196442 A1 * 7/2015 Heil ..... A61G 7/005 5/618
2015/0282630 A1 10/2015 Mcintyre
2015/0305954 A1 10/2015 Kuenzler
2016/0242561 A1 8/2016 Riley et al.
2017/0251817 A1 * 9/2017 Atkinson, Jr. ..... B66F 7/0641
2018/0242751 A1 * 8/2018 MacNaughton ..... A47C 20/10

FOREIGN PATENT DOCUMENTS

CN 205548102 U 9/2016
EP 2712597 A2 4/2014
JP 2004000444 A 1/2004
WO 2013164851 A2 11/2013

OTHER PUBLICATIONS

PCT/US2018/023252 International Search Report and Written Opinion of the International Searching Authority—European Patent Office dated Jun. 5, 2018.

* cited by examiner

ZERO GRAVITY BED

TECHNICAL FIELD

The present disclosure generally relates to bedding and more particularly to bed frames that drop in the center to move to a zero gravity position. Methods of use are included.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Studies have shown that sleeping on a flat surface is not conducive for restful sleep. Moreover, these studies have shown that sleeping on a flat surface, after a long time, can cause or trigger illnesses such as, for example, migraines, Alzheimer's disease, glaucoma, sleep apnea, stroke, impotency, and similar illnesses. Bed frames have thus been developed that allow the sleep surface of a bed to move from a horizontal position to an inclined position. However, such bed frames do not allow certain sections of the bed frame, such as, for example, a section of the bed frame that supports at least a portion of a sleeper's abdomen, to move relative to other sections of the bed frame, thus limiting the adjustability of the bed frame. This disclosure describes an improvement over these prior art technologies.

SUMMARY

In one embodiment, in accordance with the principles of the present disclosure, a bed frame is provided that includes a lower frame and an upper frame having a first section, a second section and a third section. The second section is positioned between the first section and the third section. The first section is pivotable relative to the lower frame. The third section is fixed relative to the lower frame. The second section is pivotable relative to the first section and the third section. A lifting assembly includes a first end that is coupled to the lower frame and a second end that is coupled to the second section. The lifting assembly is configured to selectively move the second section toward and away from the lower frame.

In one embodiment, in accordance with the principles of the present disclosure, a bed frame is provided that includes a lower frame and an upper frame having a first section, a second section and a third section. The second section is positioned between the first section and the third section. The first section is pivotable relative to the lower frame. The second section is pivotable relative to the first section and the second section. The third section is fixed relative to the lower frame. A lifting assembly is positioned between the lower frame and the second section. The lifting assembly is configured to selectively move the second section toward and away from the lower frame and to move the bed frame between a first configuration in which the sections are parallel to one another and a second configuration in which the first and third sections each extend at an acute angle relative to the second section.

In one embodiment, in accordance with the principles of the present disclosure, a bed frame is provided that includes a lower frame comprising a planar surface and spaced apart first and second legs that each extend away from the planar surface. An upper frame comprises a first section, a second section and a third section. The second section is located between the first section and the third section. The third section comprises a bottom surface that is fixed to the second leg and an opposite top surface that extends parallel to the planar surface. The first section is pivotable relative to the lower frame. The second section is pivotable relative to the first section and the second section. The third section is fixed relative to the lower frame. The second section comprises a first portion that is pivotably coupled to the first section and a second portion that is pivotably coupled to the third section. The second portion is pivotable relative to the first portion. A pin extends through the first leg and the first section to allow the first section to pivot relative to the first leg. A lifting assembly is positioned between the lower frame and the second section. The lifting assembly comprises a scissor jack assembly. The scissor jack assembly comprises first and second links. The links each have a first end that is pivotably coupled to the lower frame and a second end that is pivotably coupled to the second section. The lifting assembly comprises a hydraulic cylinder and a piston that is movable relative to the hydraulic cylinder. The hydraulic cylinder is pivotably coupled to the lower frame. The piston comprises an end that is fixed to the second section. The lifting assembly comprises a controller that includes a hydraulic pump and electronic circuitry that connects the hydraulic pump and the hydraulic cylinder to allow the hydraulic pump to move the piston relative to the hydraulic cylinder. The lifting assembly is configured to selectively move the second section toward and away from the lower frame and to move the bed frame between a first configuration in which the sections are parallel to one another and a second configuration in which the first and third sections each extend at an acute angle relative to the second section.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior."

Figure 1:
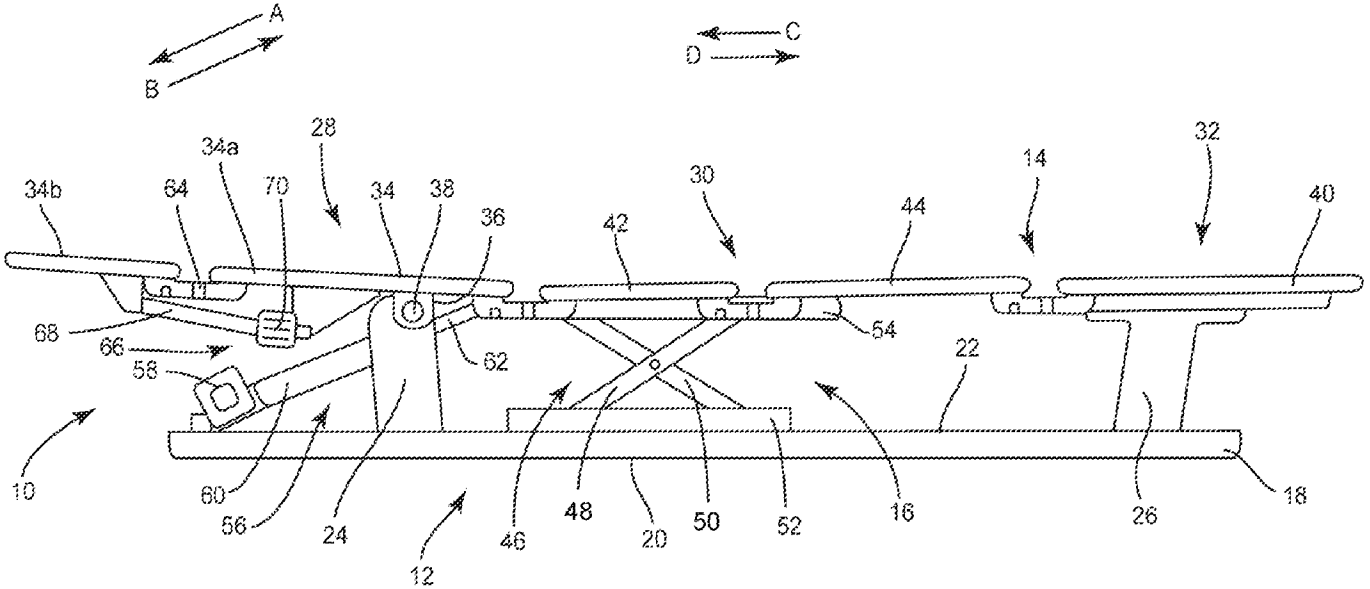
FIG. 1 is a side view of a bed frame in accordance with the principles of the present disclosure.
Figure 2:
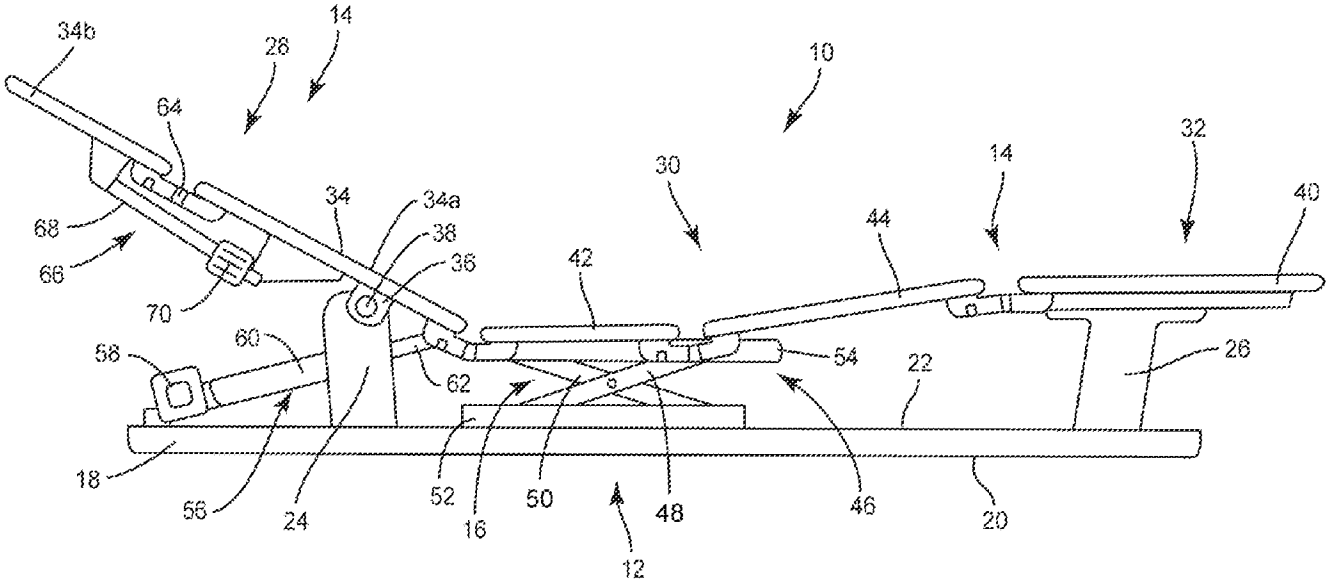
FIG. 2 is a side view of the bed frame shown in FIG. 1.
Figure 3:
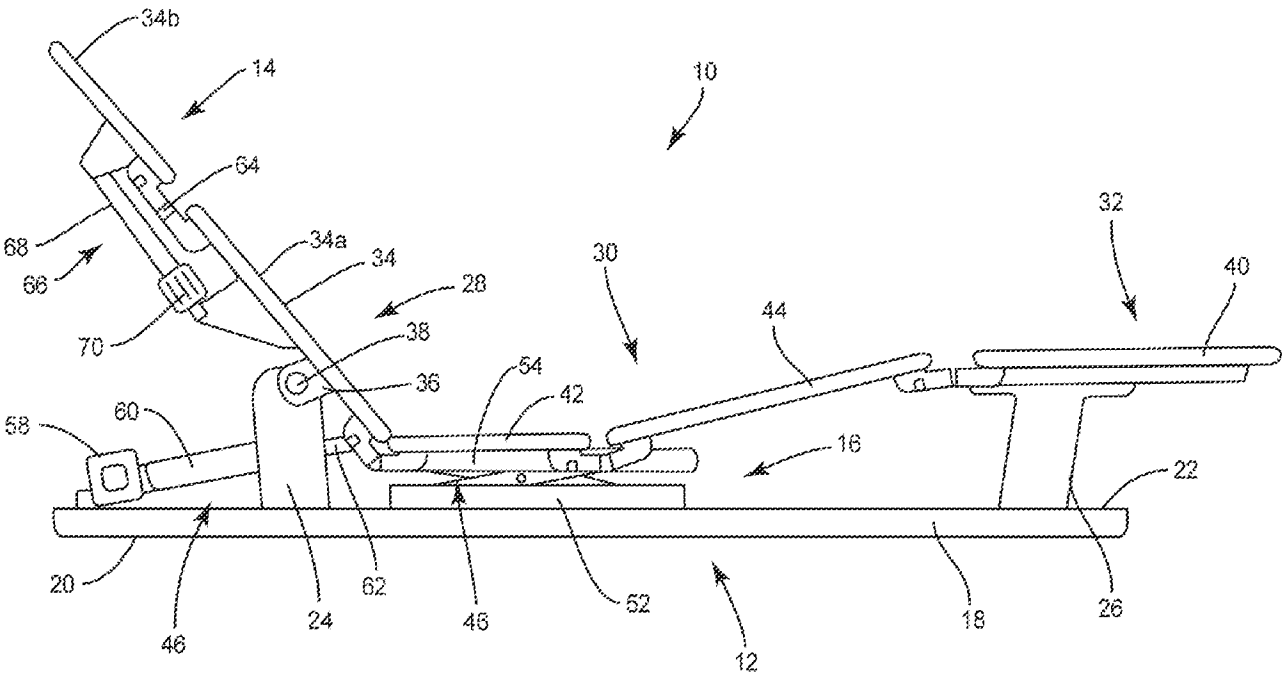
FIG. 3 is a side view of the bed frame shown in FIG. 1.

Reference will now be made in detail to the exemplary embodiments of the present disclosure, which are illustrated in the accompanying figures. Turning to FIGS. 1-3, there are illustrated components of a bed frame 10.

Frame 10 comprises a frame 12, a frame 14 positioned above frame 12 and a lifting assembly 16 positioned between frame 12 and frame 14. Frame 12 includes a body 18 having a surface 20 and a surface 22 opposite surface 20. Surface 20 is configured to be positioned on a floor of a room in which bed frame 10 is disposed. Surfaces 20, 22 are each planar and surface 22 extends parallel to surface 20. A first end of frame 12 includes a leg 24 that extends from surface 22 and a second end of frame 12 includes a leg 26 that extends from surface 22. In some embodiments, surfaces 20, 22 may be disposed at alternate orientations, relative to one another, such as, for example, transverse and/or other angular orientations such as acute or obtuse.

In some embodiments, surface 20 is made from and/or has applied thereto a non-skid material, such as, for example, rubber to prevent frame 10 from moving relative to a floor of a room in which bed frame 10 is disposed. In some embodiments, wheels or casters are coupled to frame 12 to allow frame 10 to be selectively moved within a room in which bed frame 10 is disposed. In some embodiments, at least one of legs 24, 26 extends perpendicular to surface 22. In some embodiments, at least one of legs 24, 26 extends transverse to surface 22. In some embodiments, at least one of legs 24, 26 is pivotable relative to surface 22 such that the angle of leg 24 and/or leg 26 relative to surface 22 can be selectively adjusted. In some embodiments, at least one of legs 24, 26 is permanently fixed relative to surface 22 such that leg 24 and/or leg 26 cannot be moved relative to surface 22 without breaking leg 24 and/or leg 26.

Frame 14 includes a section 28 that is coupled to leg 24, a section 30, and a section 32 that is coupled to leg 26. Section 30 is positioned between section 28 and section 32. Section 28 is configured to support the upper body of at least one sleeper, section 30 is configured to support the midsection of at least one sleeper, and section 32 is configured to support the legs and/or feet of at least one sleeper. A portion of lifting assembly 16 is positioned between frame 12 and section 30 to allow section 30 to move toward and away from surface 22 of frame 12, as discussed herein. In some embodiments, leg 24 includes a pair of spaced apart legs 24 that are each coupled to section 28 and/or leg 26 includes a pair of spaced apart legs 26 that are each coupled to section 32.

Section 28 includes a panel 34 and a flange 36 that extends from panel 34. A pin 38 extends through flange 36 and leg 24. Section 28 and/or panel 34 is/are pivotable relative to leg 24 and/or frame 12. This allows section 28 to move between a first position in which an upper surface of panel 34 that faces away from surface 22 extends parallel to surface 22 and a second position in which the upper surface of panel 34 extends transverse to surface 22.

Section 32 includes a panel 40 that is permanently fixed relative to leg 26. That is, panel 40 cannot move relative to leg 26 without breaking panel 40 and/or leg 26. In some embodiments, an upper surface of panel 40 that faces away from surface 22 extends parallel to surface 22. In some embodiments, the upper surface of panel 40 extends substantially parallel to surface 22. In some embodiments, the upper surface of panel 40 extends transverse parallel to surface 22.

Section 30 includes a panel 42 that is pivotably coupled to panel 34 of section 28 and a panel 44 that is pivotably coupled to panel 40 of section 32. Panel 44 is pivotable relative to panel 42. This configuration allows section 30 to move between a first position in which an upper surface of at least one of panels 42, 44 that faces away from surface 22 extends parallel to surface 22 and a second position in which the upper surface of at least one of panels 42, 44 extends transverse to surface 22. In some embodiments, panel 42 is pivotably coupled to panel 34 of section 28 and/or panel 44 is pivotably coupled to panel 40 of section 32 via one or more hinges. In some embodiments, at least one of the hinges is a barrel hinge, a pivot hinge, a mortise hinge, a case hinge, a piano hinge, a concealed hinge, a butterfly hinge, a flag hinge, a strap hinge, an H hinge, an HL hinge, a counter flap hinge, a flush hinge, a coach hinge, a rising butt hinge, a double action spring hinge, a tee hinge, a friction hinge, a security hinge, a cranked hinge, a lift-off hinge, or a self-closing hinge.

In some embodiments, leg 24 includes a single leg 24 and/or leg 26 includes a single leg 26. In some embodiments, leg 24 includes a pair of spaced apart legs 24 and/or leg 26 includes a pair of spaced apart legs 26. In some embodiments wherein leg 24 includes a pair of spaced apart legs 24, flange 36 of panel 34 includes a pair of spaced apart flanges 36; one of flanges 36 engages one of legs 24 and the other one of flanges 36 engages the other one of legs 24; pin 38 extends through flanges 36 and legs 24. In some embodiments wherein leg 26 includes a pair of spaced apart legs 26, one side of panel 40 engages one of legs 26 and an opposite side of panel 40 engages the other one of legs 26.

Lifting assembly 16 includes a scissor jack 46 having a link 48 and a link 50 that is pivotable relative to link 48. First ends of links 48, 50 are each coupled to a bracket 52 of frame 12 that is fixed to surface 22 such that the first ends of links 48, 50 are spaced apart from one another. The first end of link 48 is fixed relative to bracket 52 and the first end of link 50 is movable relative to bracket 52. Opposite second ends of links 48, 50 are each coupled to a bracket 54 of section 30 that is fixed to panel 42 such that the second ends of links 48, 50 are spaced apart from one another. The second end of link 48 is fixed relative to bracket 54 and the second end of link 50 is movable relative to bracket 54. In some embodiments, the first end of link 50 includes a projection that translates within a groove in bracket 52 that extends parallel to surface 22 as link 50 pivots relative to link 48 and the second end of link 50 includes a projection that translates within a groove in bracket 54 that extends parallel to surface 22 and/or panel 42 as link 50 pivots relative to link 48.

Lifting assembly 16 includes an arm 56 that is positioned between arms 24. An end of arm 56 is coupled to frame 12. In some embodiments, arm 56 is fixed relative to frame 12 and/or frame 14. In some embodiments, arm 56 is pivotable relative to frame 12. In such embodiments, a pin may extend through the end of arm 56 and a portion of frame 12 to allow arm 56 to pivot relative to frame 12 about the pin. Arm 56 includes a controller 58, a hydraulic cylinder 60 that is coupled to controller 58 and a piston 62 that is movable relative to cylinder 60. An end of piston 62 is coupled to the second end of link 50. Controller 58 includes a hydraulic pump and electronic circuitry that connects the pump with cylinder 60 to allow the pump to move piston 62 relative to cylinder 60, as discussed herein. In some embodiments, the end of piston 62 is directly coupled to the second end of link 50 such that the end of piston 62 directly engages the second end of link 50. In some embodiments, the end of piston 62 is coupled to the second end of link 50 via a connector or bracket that connects the end of piston 62 with the second end of link 50. In some embodiments, the connector or bracket that connects the end of piston 62 with the second end of link 50 also connects panel 34 with panel 42 in a manner that allows panel 34 to pivot relative to panel 42. In some embodiments, controller 58 may be operated remotely via a remote control, for example, that communicates wirelessly with controller 58 to move piston 62 relative to cylinder 60, as discussed herein.

In some embodiments, link 48 includes a single link 48 and link 50 includes a single link 50. In some embodiments, link 48 includes a pair of links 48 and link 50 includes a pair of links 50. In some embodiments, links 48 are spaced apart from one another and links 50 are spaced apart from one another. In some embodiments, piston 62 is positioned equidistant between links 50. In some embodiments, one of links 50 engages first sidewalls of brackets 52, 54 and the other one of links 50 engages opposite second sidewalls of brackets 52, 54. Likewise, one of links 48 engages first sidewalls of brackets 52, 54 and the other one of links 48 engages opposite second sidewalls of brackets 52, 54. In some embodiments, piston 62 engages the second ends of links 50. In some embodiments, the end of piston 62 includes a connector, such as, for example, a rod or plate that extends between and connects the second ends of links 50 such that moving piston 62 relative to cylinder 60 also moves the second ends of links 50.

Piston 62 is movable relative to cylinder 60 in a first direction, such as, for example, the direction shown by arrow A in FIG. 1 and an opposite second direction, such as, for example, the direction shown by arrow B in FIG. 1 to move frame 10 between a first configuration in which sections 28, 30, 32 each extend parallel or substantially parallel to surface 22, as shown in FIG. 1, and a second configuration in which at least one of sections 28, 30, 32 extends transverse to surface 22, as shown in FIGS. 2 and 3. When frame 10 is in the first configuration, panels 34, 40, 42, 44 each extend parallel or substantially parallel to one another. When frame 10 is in the second configuration, at least one of panels 34, 40, 42, 44 extends transverse to another one of panels 34, 40, 42, 44. As frame 10 moves from the first configuration to the second configuration, section 30 moves toward surface 22 of frame 12. Stated another way, as frame 10 moves from the second configuration to the first configuration, section 30 moves away from surface 22 of frame 12.

To move frame 10 from the first configuration to the second configuration, controller 58 causes piston 62 to move relative to cylinder 60 in the direction shown by arrow A in FIG. 1 such that piston 62 moves the second end of link 50 relative to bracket 54 in the direction shown by arrow C in FIG. 1. As the second end of link 50 moves relative to bracket 54 in the direction shown by arrow C, the first end of link 50 moves relative to bracket 52 in the direction shown by arrow D in FIG. 1. As the ends of link 50 move relative to brackets 52, 54, link 50 pivots relative to link 48 such that the distance between section 30 and surface 22 is decreased. That is, section 30 moves toward surface 22. Moving piston 62 in the direction shown by arrow A in FIG. 1 a first amount causes the distance between section 30 and surface 22 to decrease to a first distance, as shown in FIG. 2. Moving piston 62 in the direction shown by arrow A in FIG. 1 an increased second amount causes the distance between section 30 and surface 22 to decrease to a second distance, as shown in FIG. 3. As section 30 moves toward surface 22, panel 42 pivots relative to panel 44 such that panel 44 extends transverse to panel 42, panel 34 pivots relative to panel 42 such that panel 42 extends transverse to panel 34, and panel 44 pivots relative to panel 40 such that panel 40 extends transverse to panel 44, as shown in FIGS. 2 and 3.

When frame 10 is in the first configuration, panels 34, 40, 42, 44 each extend parallel or substantially parallel to one another; and when frame 10 is in the second configuration, at least one of panels 34, 40, 42, 44 extends transverse to another one of panels 34, 40, 42, 44, as discussed above. As such, moving frame 10 from the first configuration to the second configuration allows frame 10 to move such that at least a portion of each of sections 28, 32 are positioned above at least a portion of section 30. This moves a sleeper's head and feet above his or her midsection so that his or her body assumes a neutral spinal posture, which exerts the least amount of stress on the sleeper's bones and joints.

To move frame 10 from the second configuration to the first configuration, controller 58 causes piston 62 to move relative to cylinder 60 in the direction shown by arrow B in FIG. 1 such that piston 62 moves the second end of link 50 relative to bracket 54 in the direction shown by arrow D in FIG. 1. As the second end of link 50 moves relative to bracket 54 in the direction shown by arrow D, the first end of link 50 moves relative to bracket 52 in the direction shown by arrow C in FIG. 1. As the ends of link 50 move relative to brackets 52, 54, link 50 pivots relative to link 48 such that the distance between section 30 and surface 22 is increased. That is, section 30 moves away from surface 22. Moving piston 62 in the direction shown by arrow B in FIG. 1 a first amount causes the distance between section 30 and surface 22 to increase to a first distance, as shown in FIG. 2. Moving piston 62 in the direction shown by arrow B in FIG. 1 an increased second amount causes the distance between section 30 and surface 22 to increase to a second distance, as shown in FIG. 1. As section 30 moves away from surface 22, panel 42 pivots relative to panel 44 such that panel 44 extends parallel to panel 42, panel 34 pivots relative to panel 42 such that panel 42 extends parallel to panel 34, and panel 44 pivots relative to panel 40 such that panel 40 extends parallel to panel 44, as shown in FIG. 1.

In some embodiments, panel 34 is monolithic. In some embodiments, panel 34 includes a portion **34*a* and a portion 34*b* that is movably connected to portion 34*a* by a bracket 64. Portions 34*a*, 34*b* define a total length of panel 34. An end of bracket 64 is movable relative to portion 34*a* and an opposite end of bracket 64 is fixed to portion 34*b*. In some embodiments, a portion of the end of bracket 64 that is movable relative to portion 34*a* is movably positioned within a channel of portion 34*a*. An actuator 66 includes a shaft 68 that is coupled to a flange of portion 34*b* and a coupling 70 that engages a flange of portion 34*a*. An end of shaft 68 is positioned within coupling 70 and coupling 70 is rotatable relative to shaft 68 to increase and decrease the length of actuator 66. In particular, rotating coupling 70 relative to shaft 68 in a first direction, such as for example, clockwise or counterclockwise, causes the amount of shaft 68 that is positioned within coupling 70 to decrease such that portion 34***b* moves toward portion 34*a*. Rotating coupling 70 relative to shaft 68 in an opposite direction causes the amount of shaft 68 that is positioned within coupling 70 to increase such that portion 34*b* moves away from portion 34*a*. This configuration allows the total length of panel 34 to be selectively increased or decreased by rotating coupling 70 relative to shaft 68. In some embodiments, shaft 68 translates relative to coupling 70 via threaded engagement between shaft 68 and coupling 70. For example, shaft 68 may include a threaded outer surface that engages a threaded inner surface of coupling 70.

In some embodiments, lifting assembly 16 includes only one scissor jack 46, as shown in FIGS. 1-3. In some embodiments, lifting assembly 16 includes a plurality of scissor jacks 46 that are each positioned between frame 12 and section 30. In some embodiments, a single arm 56 is configured to operate each of scissor jacks 46. In some embodiments, each scissor jack 46 includes its own arm 56 such that one of arms 56 operates one of scissor jacks 46. In some embodiments, frame 10 includes one or a plurality of lifting assemblies that is/are the same or similar to lifting assembly 16 in place of arm(s) 24 to allow section 28 to selectively move toward and away from frame 12. In some embodiments, frame 10 includes one or a plurality of lifting assemblies that is/are the same or similar to lifting assembly 16 in place of arm(s) 26 to allow section 32 to selectively move toward and away from frame 12.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bed frame comprising:

a lower frame;

an upper frame comprising a first section, a second section and a third section, the second section positioned between the first section and the third section, the first section being pivotable relative to the lower frame, the second section being pivotable relative to the first section and the third section; and a lifting assembly comprising a first end that is coupled to the lower frame and a second end that is coupled to the second section, the lifting assembly being configured to selectively move the second section toward and away from the lower frame, wherein the lifting assembly is configured to move the bed frame between a first configuration in which the sections are parallel to one another and a second configuration in which the first and third sections each extend at an obtuse angle relative to the second section, and wherein the third section is non-movable relative to the lower frame as the bed frame moves between the first and second configurations.

2. A bed frame as recited in claim 1, wherein the second section comprises a first portion that is coupled to the first section and a second portion that is coupled to the third section, the second portion being pivotable relative to the first portion.

3. A bed frame as recited in claim 1, wherein the second section comprises a first portion that is pivotably coupled to the first section and a second portion that is pivotably coupled to the third section, the second portion being pivotable relative to the first portion.

4. A bed frame as recited in claim 1, wherein the lower frame comprises a planar surface and a leg that extends from the planar surface, the bed frame comprising a pin that extends through the leg and the first section to allow the first section to pivot relative to the leg.

5. A bed frame as recited in claim 1, wherein the lower frame comprises a planar surface and a leg that extends from the planar surface, the third section being fixed to the leg.

6. A bed frame as recited in claim 1, wherein the lower frame comprises a planar surface and a leg that extends from the planar surface, the third section comprising a bottom surface that is fixed to the leg and an opposite top surface that extends parallel to the planar surface.

7. A bed frame as recited in claim 1, wherein the lifting assembly comprises a hydraulic cylinder and a piston that is movable relative to the hydraulic cylinder.

8. A bed frame as recited in claim 1, wherein the lifting assembly comprises a hydraulic cylinder and a piston that is movable relative to the hydraulic cylinder, the hydraulic cylinder being pivotably coupled to the lower frame and the piston comprising an end that is coupled to a scissor jack assembly of the lifting assembly.

9. A bed frame as recited in claim 1, wherein the lifting assembly comprises:

a hydraulic cylinder and a piston that is movable relative to the hydraulic cylinder, the hydraulic cylinder being pivotably coupled to the lower frame and the piston comprising an end that is coupled to a scissor jack assembly of the lifting assembly; and a controller that includes a hydraulic pump and electronic circuitry that connects the hydraulic pump and the hydraulic cylinder to allow the hydraulic pump to move the piston relative to the hydraulic cylinder.

10. A bed frame as recited in claim 1, wherein the lifting assembly comprises a scissor jack assembly.

11. A bed frame as recited in claim 1, wherein the first section comprises a first portion and a second portion that is movably connected to the first portion by a bracket, the bed frame comprising an actuator, the actuator including a shaft that is coupled to a flange of the second portion, the actuator including a coupling that engages a flange of the first portion, an end of the shaft being positioned within the coupling, the coupling being rotatable relative to the shaft to increase and decrease a distance between the first portion and the second portion.

12. A bed frame as recited in claim 1, wherein the lifting assembly comprises a scissor jack assembly, the scissor jack assembly comprising a first and second links, the links each having a first end that is coupled to the lower frame and a second end that is coupled to the second section.

13. A bed frame as recited in claim 12, wherein the scissor jack assembly comprises a pin that extends through the first link and the second link to allow the first link to pivot relative to the second link.

14. A bed frame as recited in claim 12, wherein the lifting assembly comprises a hydraulic cylinder and a piston that is movable relative to the hydraulic cylinder, the hydraulic cylinder being pivotably coupled to the lower frame and the piston comprising an end that is coupled to one of the links.

15. A bed frame as recited in claim 12, wherein the lifting assembly comprises:

a hydraulic cylinder and a piston that is movable relative to the hydraulic cylinder, the hydraulic cylinder being pivotably coupled to the lower frame and the piston comprising an end that is coupled to one of the links; and a controller that includes a hydraulic pump and electronic circuitry that connects the hydraulic pump and the hydraulic cylinder to allow the hydraulic pump to move the piston relative to the hydraulic cylinder.

16. A bed frame comprising:

a lower frame;

an upper frame comprising a first section, a second section and a third section, said second section positioned between the first section and the third section, the first section being pivotable relative to the lower frame, the second section being pivotable relative to the first section and the third section; and a lifting assembly positioned between the lower frame and the second section, the lifting assembly being configured to selectively move the second section toward and away from the lower frame and to move the bed frame between a first configuration in which the sections are parallel to one another and a second configuration in which the first and third sections each extend at an obtuse angle relative to the second section, the third section being non-movable relative to the lower frame as the bed frame moves between the first and second configurations.

17. A bed frame as recited in claim 16, wherein the lifting assembly comprises a scissor jack assembly, the scissor jack assembly comprising a first and second links, the links each having a first end that is coupled to the lower frame and a second end that is coupled to the second section.

18. A bed frame as recited in claim 17, wherein the lifting assembly comprises a hydraulic cylinder and a piston that is movable relative to the hydraulic cylinder, the hydraulic cylinder being pivotably coupled to the lower frame and the piston comprising an end that is coupled to one of the links.

19. A bed frame as recited in claim 17, wherein the lifting assembly comprises:

a hydraulic cylinder and a piston that is movable relative to the hydraulic cylinder, the hydraulic cylinder being pivotably coupled to the lower frame and the piston comprising an end that is coupled to one of the links; and a controller that includes a hydraulic pump and electronic circuitry that connects the hydraulic pump and the hydraulic cylinder to allow the hydraulic pump to move the piston relative to the hydraulic cylinder.

20. A bed frame comprising:

a lower frame comprising a planar surface and spaced apart first and second legs that each extend away from the planar surface;

an upper frame comprising a first section, a second section and a third section, said second section located between the first section and the third section, the third section comprising a bottom surface that is fixed to the second leg and an opposite top surface that extends parallel to the planar surface, the first section being pivotable relative to the lower frame, the second section being pivotable relative to the first section and the third section, the second section comprising a first portion that is pivotably coupled to the first section and a second portion that is pivotably coupled to the third section, the second portion being pivotable relative to the first portion;

a pin that extends through the first leg and the first section to allow the first section to pivot relative to the first leg; and a lifting assembly positioned between the lower frame and the second section, the lifting assembly comprising a scissor jack assembly, the scissor jack assembly comprising a first and second links, the links each having a first end that is pivotably coupled to the lower frame and a second end that is pivotably coupled to the second section, the lifting assembly comprising a hydraulic cylinder and a piston that is movable relative to the hydraulic cylinder, the hydraulic cylinder being pivotably coupled to the lower frame and the piston comprising an end that is coupled to one of the links, the lifting assembly comprising a controller that includes a hydraulic pump and electronic circuitry that connects the hydraulic pump and the hydraulic cylinder to allow the hydraulic pump to move the piston relative to the hydraulic cylinder, wherein the lifting assembly is configured to selectively move the second section toward and away from the lower frame and to move the bed frame between a first configuration in which the sections are parallel to one another and a second configuration in which the first and third sections each extend at an obtuse angle relative to the second section, and wherein the third section is non-movable relative to the lower frame as the bed frame moves between the first and second configurations.

* * * * *